US007028877B2

(12) United States Patent
Sperrfechter et al.

(10) Patent No.: US 7,028,877 B2
(45) Date of Patent: Apr. 18, 2006

(54) COMBUSTION—OPERATED WORKING TOOL, IN PARTICULAR A SETTING TOOL FOR FASTENING ELEMENTS

(75) Inventors: Thomas Sperrfechter, Grüsch (CH); Jens Neumann, Feldkirch (AT); Norbert Heeb, Buchs (CH); Gerhard Ehmig, Rankweil (AT); Tilo Dittrich, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 144 days.

(21) Appl. No.: 10/739,867

(22) Filed: Dec. 18, 2003

(65) Prior Publication Data

US 2004/0226975 A1 Nov. 18, 2004

(30) Foreign Application Priority Data

Dec. 19, 2002 (DE) ..... 102 59 772

(51) Int. Cl.
*B25C 1/14* (2006.01)

(52) U.S. Cl. ..... 227/10

(58) Field of Classification Search ..... 227/8–11; 89/26, 1.14

See application file for complete search history.

(56) References Cited

U.S. PATENT DOCUMENTS

| | | | | |
|---|---|---|---|---|
| 3,690,536 | A | 9/1972 | Bakoledis | |
| 3,743,159 | A * | 7/1973 | Schneider | 227/10 |
| 3,771,452 | A * | 11/1973 | Reed et al. | 89/26 |
| 3,981,424 | A * | 9/1976 | Maier | 227/10 |
| 4,066,198 | A * | 1/1978 | Jochum et al. | 227/8 |
| 4,130,231 | A | 12/1978 | Jacoviello | |
| 5,617,925 | A * | 4/1997 | Boothby et al. | 227/10 |
| 6,286,743 | B1 * | 9/2001 | Ehmig | 227/9 |
| 6,796,478 | B1 * | 9/2004 | Shkolnikov et al. | 227/10 |
| 2003/0218041 | A1 * | 11/2003 | Dittrich et al. | 227/10 |

FOREIGN PATENT DOCUMENTS

| | | |
|---|---|---|
| EP | 1120201 | 8/2001 |
| EP | 1197301 | 4/2002 |
| GB | 1002292 | 8/1965 |
| GB | 2091395 | 7/1982 |

* cited by examiner

*Primary Examiner*—Scott A. Smith
(74) *Attorney, Agent, or Firm*—Abelman, Frayne & Schwab

(57) ABSTRACT

A combustion-operated working tool having a housing body (1), which has a cylindrical recess (5) and a piston chamber (2) connecting therewith for receiving a piston (3); an impact plate (8), which is arranged opposite to and at a distance to the cylindrical recess (5) and which can be displaced towards and away from the housing body (1), and a packing sleeve (12) arranged inside and elastically mounted, projecting out of the cylindrical recess (5).

22 Claims, 8 Drawing Sheets

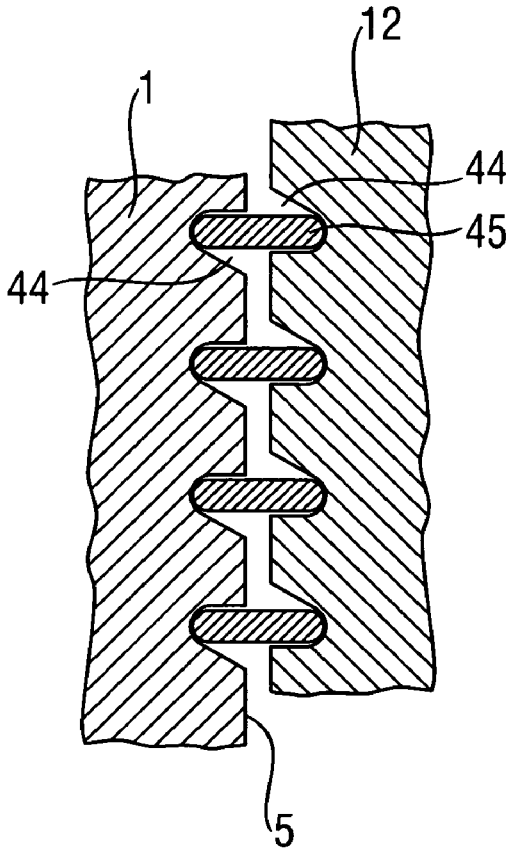
Fig. 8A
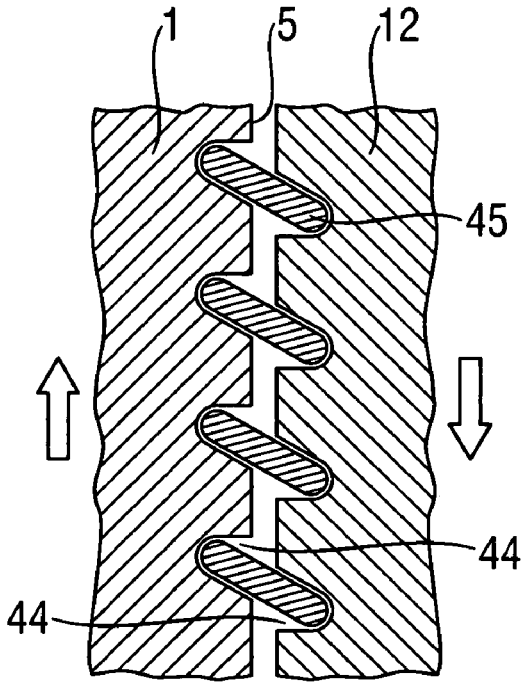
Fig. 8B
Fig. 8

COMBUSTION—OPERATED WORKING TOOL, IN PARTICULAR A SETTING TOOL FOR FASTENING ELEMENTS

BACKGROUND OF THE INVENTION

The invention relates to a combustion-operated working tool, in particular a setting tool for fastening elements, having a housing body, which has a cylindrical recess and a piston chamber communicating therewith for receiving a piston; an impact plate, which is arranged separately spaced opposite to the cylindrical recess facing the housing body and can be moved away from same, and a packing sleeve arranged in the cylindrical recess and projecting therefrom.

DE 199 05 896 A1 discloses a powder-power operated setting tool, which has a first part in the form of a guide cylinder and a second part in the form of an impact plate. Both parts are essentially arranged coaxial to each other and can be displaced parallel to each other in the setting direction. The end zone of the first part facing towards the impact plate has a cartridge bearing, which serves to receive the cartridges. In the setting direction a cartridge chamber communicates with the cartridge bearing and a driver piston is arranged axially displaceable in the chamber. The piston chamber communicates with the cartridge chamber via a connection bore hole.

The impact plate has an axially displaceable mounted bushing on its side facing the guide cylinder. Immediately after firing the cartridge the seal bushing will be urged against the guide cylinder by the accumulating very high pressure if there is a still unused cartridge present in the cartridge bearing and if the impact plate is shifted in towards the guide cylinder, which results in a very reliable sealing of the cartridge bearing in the zone between the guide cylinder and the impact plate.

The packing sleeve is held on the impact plate using an annular discoid elastic membrane. This membrane is fastened securely to the setting side surface of the impact plate. The sealing element has a sealing projection on its setting side surface, which is formed from a peripheral thin-walled projection.

SUMMARY OF THE INVENTION

The object of the invention is to provide a further working tool of the aforementioned type. In particular, the impact plate has a very slight weight such that it can be driven quickly using as low a power as possible.

The solution of the problem is solved according to the invention by a combustion-operated working tool, in particular a setting tool for fastening elements, which can also be a powder—operated working tool, comprising a device body, which has a cylindrical recess and a piston chamber communicating therewith for receiving a piston; an impact plate, which is arranged opposite the cylindrical recess and can be moved towards or away from the device body, and a packing sleeve mounted in the cylindrical recess and which can be moved out of the cylindrical recess.

The packing sleeve is carried by the device body and not by the impact plate so that the impact plate has a lesser mass. It can therefore be displaced more lightly and faster assisting in improved operational control of the working tool. High forces are no longer required for driving the impact plate thus saving energy. Furthermore, the drives for driving the impact plate can be configured more simply resulting in costs savings and weight economies.

According to a further embodiment of the invention, the packing sleeve can be urged by a spring force against the impact plate such that tolerances inter alia can be balanced in the transmission system driving the impact plate.

According to an embodiment of the invention, the central axes of the piston chamber and the cylindrical recess are inclined towards each other, whereby the inclination is preferably 90°. In this fashion, the well—known side—fire concept can be realized in a working tool of the aforementioned type. This has the advantage inter alia that the cartridges can be transported along a track to the respective firing position, which lies parallel to the central axis of the piston chamber; in other words, parallel to the setting direction.

It is, however, also possible to arrange the central axes of the piston chamber and the cylindrical recess coaxial to each other. The cartridge supply system in the respective firing position would then come to be vertical to the setting direction of the working tool.

According to a very advantageous further embodiment of the invention, the packing sleeve has adjusting surfaces, by which it can be urged against the impact plate by a gas pressure, which builds after firing of the loaded cartridge.

Accordingly, a closure is created for the cartridge bearing, which generates the sealing force. The very high gas pressure occurring in the cartridge bearing or in the packing sleeve upon firing of a cartridge thus pushes the packing sleeve against the impact plate and does this with such power, that no gas can escape in the zone between the packing sleeve and the impact plate. When this is done, the sealing force is so high that even a thin walled blister cartridge is held such that it can withstand the enormous gas pressure of several 1000 bar.

The lower surface of the packing sleeve can be used as the adjusting sleeve for the gas pressure, which is always at a distance from the floor of the cylindrical recess.

Preferably, the packing sleeve is provided peripherally with seals to provide adequate gas sealing in the gap zone between the packing sleeve and the inner wall of the cylindrical recess.

When this is done, according to the embodiment of the invention, the packing sleeve can have a peripheral recess, at its end facing away from the impact plate, running in its facial surface for forming such a thin external wall section that it can be urged against the inner wall of the cylindrical recess by the very high gas pressure occurring in the cartridge bearing upon firing a cartridge.

Alternatively or in addition, the known FEY rings can be provided between the packing sleeve and the inner wall of the cylindrical recess. These FEY rings can be situated approximately in an external peripheral groove of the packing sleeve or in a peripheral groove on the inner wall of the cylindrical recess.

According to another embodiment of the invention, the packing sleeve can also be screwed into a so-called thread in the cylindrical recess. This thread is so wide that the elastically mounted packing sleeve can be pushed into its axial longitudinal sense to press elastically against the impact plate. In this manner, an initial sealing between the front edge of the packing sleeve and the impact plate can be obtained while at the same time a sufficient sealing in the zone of the thread is possible. After firing the cartridge present in the firing chamber, the packing sleeve is urged against the impact plate by the very high pressure building up, whereby it is compressed in the zone of the thread in this direction by the flanges of the increasing thread in this zone to seal at that point.

According to yet another development of the invention, the packing sleeve can be screwed into the cylindrical recess using a threaded insert. In this instance, a specially shaped thread is present on the external periphery of the packing sleeve and on the inner wall of the cylindrical recess, whereby a corresponding threaded insert is screwed into this specially shaped thread. This threaded insert is a coil made of flat strip material, wherein the width dimension of the flat band is in the radial sense of the coil. A satisfactory seal is also maintained in the zone between the packing sleeve and the cylindrical recess, when the packing sleeve is displaced in the one or the other direction relative to the device body.

According to another development of the invention, the packing sleeve is provided with an outer peripheral flange, wherein a compression spring is arranged between the outer peripheral flange and the device body. The resilient mounting of the packing sleeve in the cylindrical recess can be obtained in a simple fashion by virtue of these means. The compression spring is compelled to push out the packing sleeve from the cylindrical recess, wherein it is prevented in that the packing sleeve runs up against a stop that is present in the cylindrical recess. The aforementioned thread or an inner flange on the inner wall of the cylindrical recess is gripped by a flange on peripheral edge of the packing sleeve, which faces outward. The spring force of the compression spring is selected such that a good initial seal between the external front zone of the packing sleeve and the impact plate is maintained, when the impact plate is displaced in the direction towards the packing sleeve or in the direction towards the device body.

Naturally, the packing sleeve could be mounted in the cylindrical recess such that it can be easily tipped about its central axis to compensate for incorrect positioning between the impact plate and the device body. The packing sleeve can have an outer peripheral bulge at its end facing towards the device body, said bulge being configured convex in a plane receiving the central axis of the packing sleeve. This outer peripheral bulge could be connected in one piece to the packing sleeve or could be inserted therein and receive an elastic seal ring.

According to a further embodiment of the invention, the impact plate is a section of a solid closed ring, in whose annular plane the central axis of the cylindrical recess lies.

As a result, a very simple and stable closure part is obtained, which can sustain the closure forces of several tons. It is statically advantageous that the device weight is not prohibitive and that expansions continue to be tolerated. Preferably, the closure ring can be combined with a gas conduit for the powder exhausts that escape from the cartridge holder, which is vertical to the axis of the device.

The closure ring can be displaced back and forth for opening and closing the cartridge holder or the cylindrical recess and especially in the axial direction of the packing sleeve or the cylindrical recess. In the closed seal position, the seal ring is held by a bar that comes to rest between the device body and the seal ring. This bar is situated on the side of the device body situated radially opposite to the cylindrical recess. The bar can be led into the said zone between the seal ring and the device body or can be rotated thereinto.

In an embodiment of the invention, the combustion—operated working tool has an adjusting member on the muzzle side and can be displaced relative to the device body, said member being used to control the sealing mechanism for the impact plate such that the displacement mechanism for the impact plate moves towards the device body when the adjusting member is displaced towards the device body and the impact plate moves away from the device body, when the adjusting member is again removed from the device body. Inasmuch, the operation of the working tool can be controlled in a simple fashion using the contact/removal movement.

Furthermore, in another embodiment of the invention, it is possible to transport cartridges into the zone between the packing sleeve and the impact plate as a factor of the displacement position of the adjusting member; that is, to bring it into the firing position or out of the firing position. If the adjusting member is displaced in the direction towards the device body, an adjusting mechanism could be pre-biased, which then would guide the spent cartridge out of the firing position and move the next cartridge into position, after the adjusting member is moved far enough away from the device body and the packing sleeve has moved far enough away from the impact plate.

Blister cartridges can be used which are connected to each other in a belt. This makes easy transport of cartridges to the firing position or away from same possible.

Preferably the belt is configured such that the blister cartridges protrude from only one side of the belt and the other flat side of the belt rests on the impact plate. The back of the belt can be provided with an electrically conducting foil that serves as the counter-electrode to fire the cartridge by an electrical spar between an anode and the counter-electrode. The anode could be situated in the impact plate.

A further embodiment of the invention provides that the facial surface of the packing sleeve facing the impact plate has a peripheral, stub-like projection, which extends axially and, viewed radially, lies within. In addition, the impact plate can also have a peripheral groove for receiving the stub-like projection.

The objective is to achieve a maximally high initial tightness between the packing sleeve and the impact plate, especially when using blister cartridges, even in low gas pressure and low contact pressure. This high initial tightness is made possible by deformation of the blister foil. The deformation is made using the smallest possible stub-like projection or the smallest possible blade to keep the necessary pressing force low. Provision is made to guide the packing sleeve to a stop and to keep the blade height so minimal that the blade cannot penetrate through the foil such that the foil of the blister cartridge is not perforated by the very high closing force due to the high gas pressure occurring. The stop is made on the foil in a level zone of the face of the packing sleeve. This has the advantage that the tolerances can more easily be maintained because only tow small dimensions are involved. It must also be noted, that the support zone on the foil is large in comparison to the thickness of the foil. As a result, extrusion of the foil under high closure force can be prevented.

According to a further embodiment of the invention, the face of the packing sleeve facing the impact plate lies parallel to the impact plate and the otherwise level impact plate has a peripheral, stub-like projection situated opposite said face.

A relatively high initial tightness is achieved by virtue of this stub-like projection on the impact plate even in low gas pressure and low contact pressure. Naturally, it must be assured that the stub-like projection does not sever the blister strip foil when it penetrates into the back of the cartridge belt.

Yet another embodiment of the invention resides in the fact that the face of the packing sleeve facing the impact plate is parallel thereto and the otherwise level impact plate has a truncated conical protrusion, which projects into the packing sleeve, when the sleeve presses against the impact plate. The inner peripheral edge of the packing sleeve, situated opposite to the impact plate does not contact the peripheral surface of the circular disk-like projections, which run inclined towards the axial sense of the packing sleeve, such that, in between, the blister foil of the cartridge strip is crushed, when the packing sleeve is moved against the impact plate; nevertheless, no severing occurs. A relatively high initial tightness is obtained at even low gas pressure and low contact pressure.

In a further embodiment of the invention, the face of the packing sleeve facing the impact plate can lie parallel to the packing sleeve and the otherwise level impact plate can have a circular disk-like projection, whose peripheral edge lies opposite to the inner edge of the packing sleeve. If the impact plate and the packing sleeve move towards each other, the peripheral edge can penetrate into the plastic foil of the blister cartridge and contribute to a good sealing action without severing the plastic foil.

BRIEF DESCRIPTION OF THE DRAWINGS

The exemplary embodiments of the invention will be discussed with reference to the drawings, wherein:

FIGS. 8A and B show yet another sealing assembly for sealing a gap between the packing sleeve and device body;

DETAILED DESCRIPTION OF THE INVENTION

Figure 2:
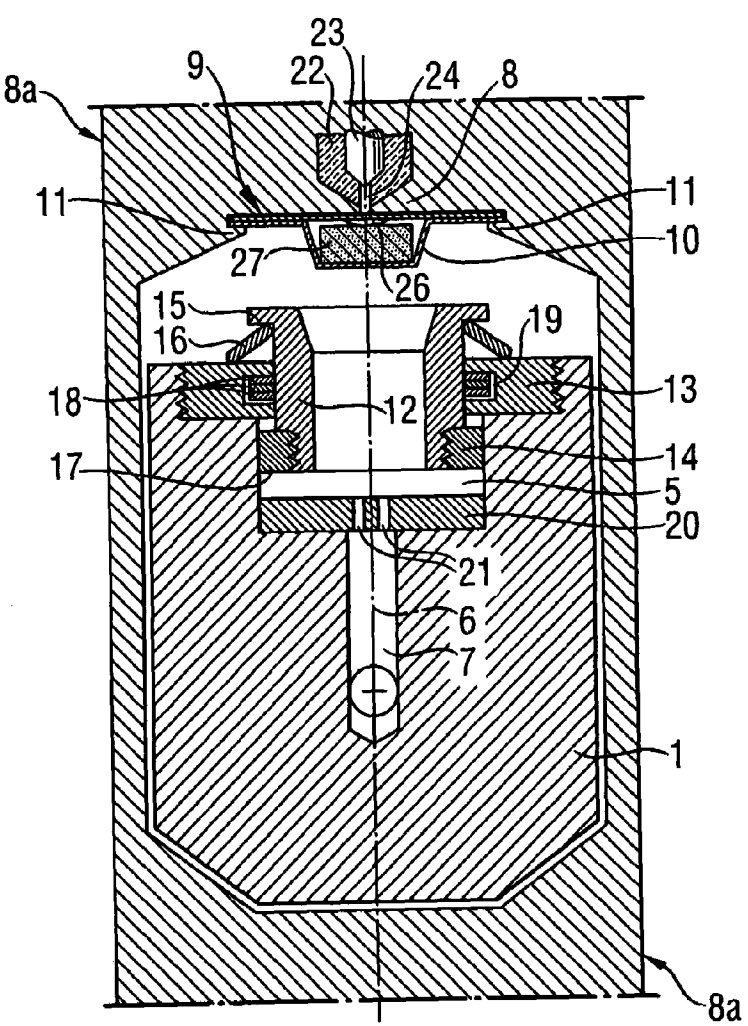
FIG. 2 shows a section along the line 2—2 of FIG. 1.

A first exemplary embodiment of the invention will be described in detail in the following with reference to FIGS. 1 to 4. In such figures, a powder-operated device with which the fastener elements can be driven into objects is shown. Blister cartridges are used as the cartridges, which are connected beltlike with each other.

The setting tool according to FIGS. 1 to 4 comprises a device body 1, in which a cylindrical piston chamber 2 is situated. The piston chamber 2 receives a driver piston 3, which is mounted axially and displaceable in the piston chamber 2. The central axis of the piston chamber 2 has the reference number 4 and corresponds with the longitudinal sense of the setting tool. In addition, inside the device body 1 there is a cylindrical recess 5, whose cylinder axis 6 runs vertical to the central axis 4. In the bottom zone of the cylindrical recess 5 it communicates with the piston chamber 2 via a connection conduit 7, whereby the connection conduit 7 runs in part coaxial to the cylinder axis 6 and further in part coaxial to the central axis 4.

An impact plate is arranged opposite to the open end of the cylindrical recess 5, which can be moved towards or away from the device body 1. Thus, the impact plate 8 is mounted displaceably in the longitudinal sense of the cylindrical axis 6 or the cylindrical recess 5. As can be seen in FIG. 2, the impact plate 8 is a section of a solid, closed ring 8*a*, in whose annular plane the central axis 6 of the cylindrical recess 5 lies. The central axis 4 of the piston chamber penetrates vertically through the annular plane. The closed ring 8*a* is preferably a single-piece and, for example, made out of steel. The closed ring 8*a* is dimensioned such that it can sustain closure forces of several tons. On the other hand this closed ring 8*a* is so advantageous, that the device weight is not excessively heavy and the expansions remain tolerable.

Figure 1:
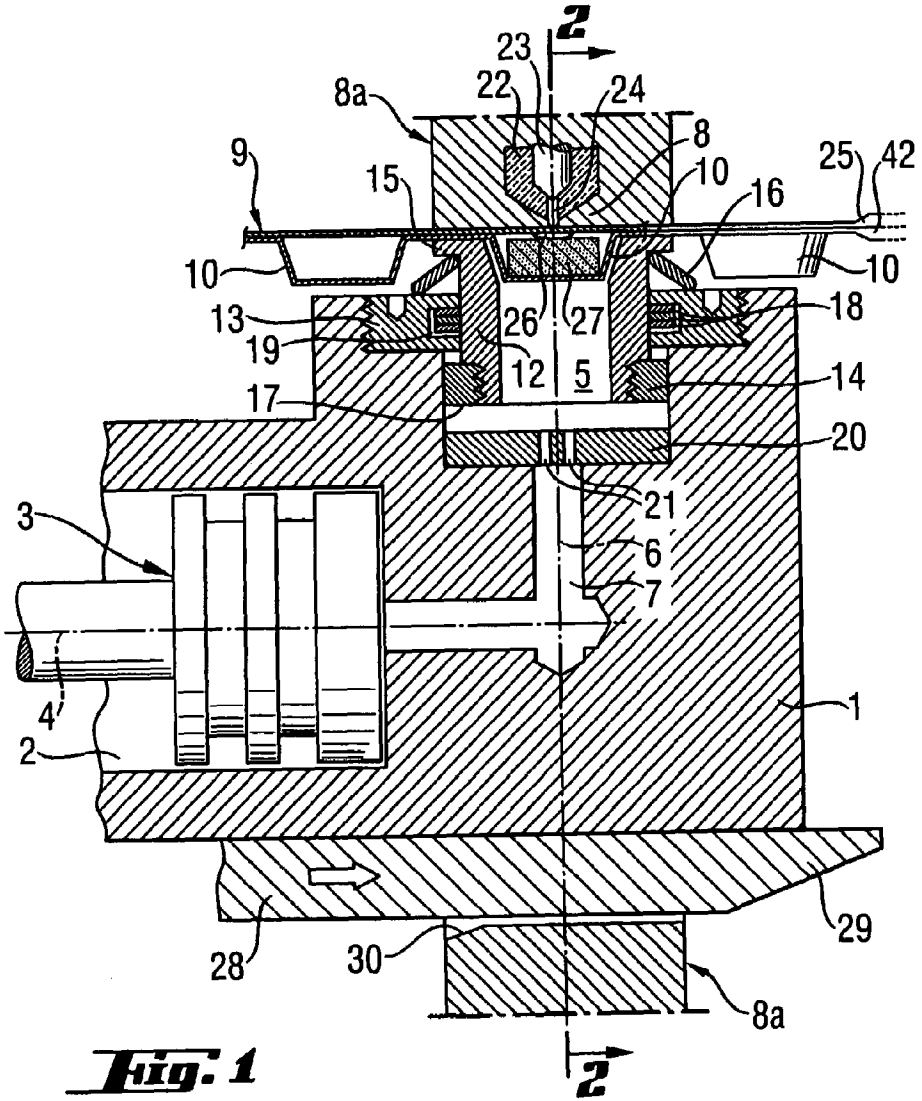
FIG. 1 shows an axial section through a combustion-operated working tool in the zone of the packing sleeve.

FIG. 1 shows a state, in which the closure ring 8*a* is displaced such that the impact plate 8 has its least distance to the device body 1. In contrast, FIG. 2 shows a displacement state of the closure ring 8*a*, in which the impact plate 8 comes to be situated at the maximum distance from the device body 1. In this state, a belt 9 containing blister cartridges 10 can be positioned within the zone between the impact plate 8 and the device body 1. For this purpose, the surface of the impact plate 8 facing towards the device body 1, in the zone opposite to the cylindrical recess 5 is essentially flat or level, wherein it serves in guiding the belt 9. The blister cartridges 10 are on only one side of the belt 9 such that the belt with its other flat side can run along the level surface of the impact plate 8. On the plate 8, the belt 9 is guided along and in the direction of the central axis 4 or the longitudinal sense of the working tool, as can be seen in FIG. 1. When this is done, the belt 9 can be held at opposing longitudinal sides by holding stubs 11, which in part grip the belt 9 and face away from the impact plate 8. By shifting the belt 9 in its longitudinal sense, a blister cartridge 10 can be brought into the firing position or transported out of said position, which lies opposite to the cylindrical recess 5.

A packing sleeve 12 is inserted into the cylindrical recess 5, which is displaceable longitudinally to the cylinder axis 6. The cylinder axis 6 of the packing sleeve 12 is coaxial with it. The packing sleeve 12 is displaceable inserted into a threaded ring 13, which in turn is screwed with its external thread into an internal thread of a cavity present in the device body 1. At the end of the packing ring facing towards the device body 1, a peripheral flange 14 is screwed onto it externally. The peripheral flange 14 grips around the threaded ring 13 to prevent the packing sleeve 12 from falling out of the cylindrical recess 5. At its end facing towards the impact plate 8, the packing sleeve 12 has a further peripheral external flange 15. A compression spring 16 is arranged between this external flange 15 and an open surface of the threaded ring 13, which is compelled to urge the packing sleeve 12 in the direction of the impact plate 8. As a result, the packing sleeve 12 cannot be urged out of the cylindrical recess 5 because the threaded ring 13 stands in the path of the peripheral flange 14.

If the closure ring 8*a* is in the position shown in FIG. 2, the impact plate 8 is removed at its most distant from the base body 1. Now, a new blister cartridge 10 can be brought into the firing position over the packing sleeve 12 by transport of the belt 9. The packing sleeve 12 is urged farthest out of the cylindrical recess 5 by the compression spring 16, whereby this position is fixed such that the peripheral flange 14 impacts against the inside of the threaded ring 13. If the closure ring 8*a*, according to FIG. 2, moves downward, the blister cartridge 10 situated in the firing position is initially guided into the upper funnel-shaped zone of the packing sleeve 12. Upon further movement of the closure ring 8*a* downwards, as in FIG. 2, the zone of the belt 9 to the side of the blister cartridge 10 ultimately comes into contact with the free face of the packing sleeve 12, which then, upon further movement of the closure ring, is pressed down against the force of the spring 16, into the cylindrical recess. This state is represented in FIG. 1. In this last movement of the packing ring 12, the compression spring 16 is compressed such that it presses the packing sleeve 12 with a specific initial sealing pressure against the belt 9 or the impact plate 8. This initial sealing force is sufficient to allow a regular combustion process inside the packing sleeve 12 after firing the blister cartridge. If the pressure continues to increase in the packing sleeve 12 after firing the blister cartridge 10 and reaches the maximum pressure, the packing sleeve 12 is pressed further by the action of this pressure and continues in the direction towards the impact plate 8 to create a sufficient seal there. For this purpose, the packing sleeve 12 is loaded via its lower front surface 17 by the combustion pressure. In other words, the packing sleeve 12 is self-sealing.

Piston rings 18, so-called FEY rings, encompass the packing ring 12 and are situated in a peripheral internal groove 19 of the threaded ring 13. Using these FEY rings, the gap zone between the packing sleeve 12 and the inner wall of the threaded ring 13 is sealed, when the high pressure forms inside the packing sleeve 12 (cartridge holder or combustion chamber) as the result of the firing of the blister cartridge 10.

A plate 20 is arranged on the floor of the cylindrical recess 5, said plate having perforation openings 21 in the direction facing the communication conduit 7 for creating a restriction point.

For firing a blister cartridge 10 present in the firing position, an insulator 22 is provided in the impact plate 8, in which an anode 23 is arranged, with the aid of which a spark can be generated through a channel 24 between the anode 23 and an electrically conducting foil 25, said foil being arranged on the back of the belt 9. As a result of the occurrence of the spark on the back of the belt 9, the electrically conducting foil 25 melts and the firing charge 26 present in the blister cartridge 10 is fired, which in turn fires the propellant charge 27 present in the blister cartridge 10.

The closure ring 8*a* is locked to prevent the impact plate 8 from being moved away from the device body 1 at the time of firing the propellant charge 27. For this purpose, a closure bar 28, which can be seen in FIG. 1, is used. If the closure ring 8*a* is displaced out of its position shown in FIG. 2, then the packing sleeve 13 [sic] is initially urged down by the impact plate 8 into the device body 1 and against the force of the compression spring 16. Then, a gap is formed between the bottom zone of the device body 1 and the closure ring 8*a*, as shown in FIG. 1. The closure bar 28 can be guided into this gap to prevent the closure ring 8*a* of FIG. 1 from again moving up. The movement regulation of the closure ring 8*a* can also be effected by the closure bar 28, which for this purpose is diagrammed in a tip one at the right of FIG. 1 as a wedge 29. The surface of the wedge faces away from the device body 1 and displaces the closure ring 8*a*, via the adjusting surface 30, and especially against the direction of effect of a reset spring (not shown). Accordingly, from the state shown in FIG. 2, the wedge 29 can be moved in the direction of the closure ring 8*a* and via the adjusting surface 30 at the closure ring 8*a* and urged via the adjusting surface 30 on the closure ring 8*a* into the position shown in FIG. 1, for which the wedge surface of the wedge 29 runs up to the adjusting surface 30. The closure ring 8*a* is then moved against the force of the reset spring (not shown). If the closure bar 28 is again moved to the left in FIG. 1 and if it leaves the zone between the device body 1 and the closure ring 8*a*, then the reset spring resets the closure ring 8*a* again in the position shown in FIG. 2.

Both the shifting movement of the closure ring 8*a* and the approach and departure of the blister cartridges 10 into the firing position and the movement of the closure bar 28 can be brought into alignment with the placement or removal of the working tool on or from the object, respectively.

Figure 3:
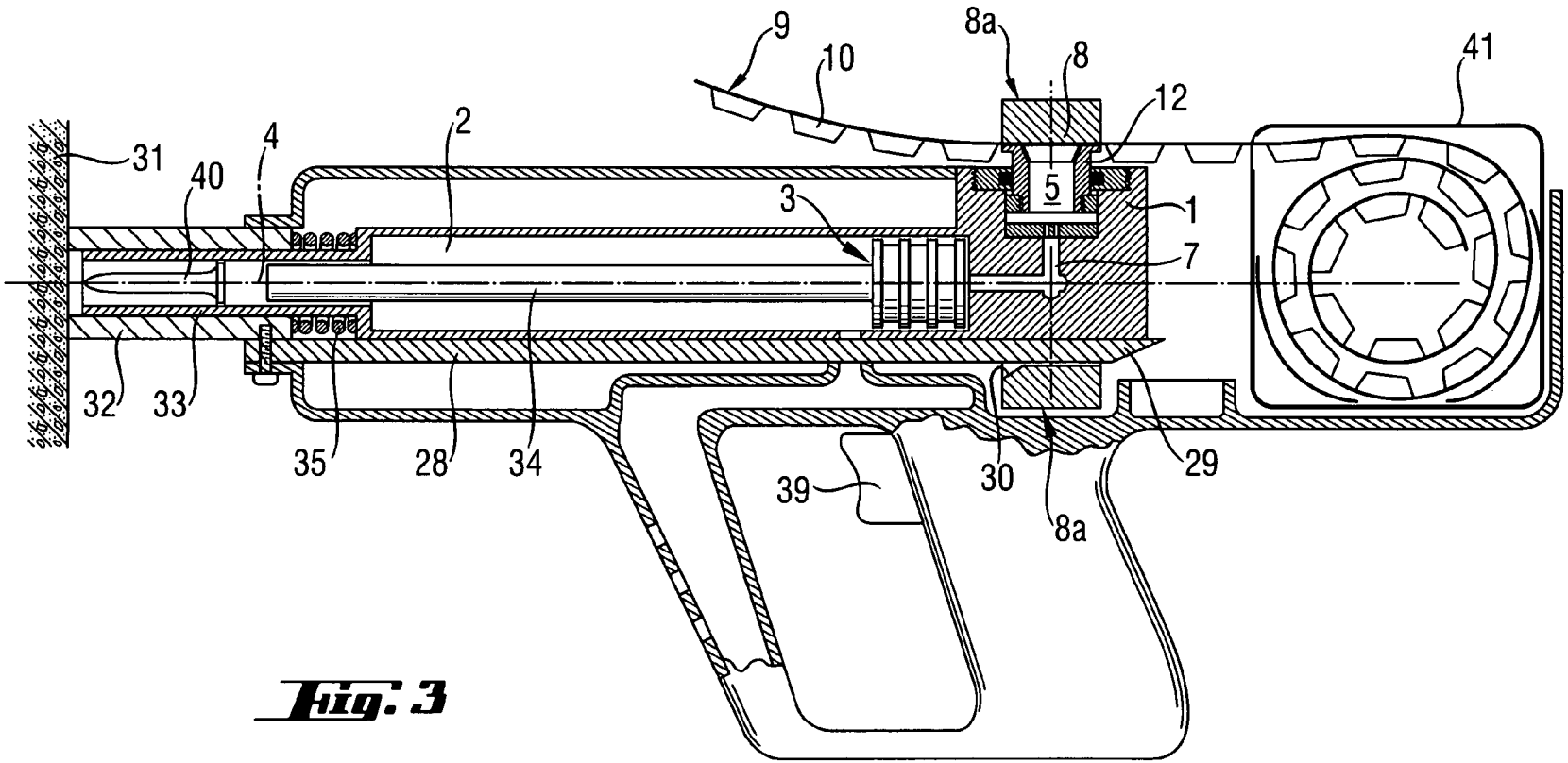
FIG. 3 shows an axial section through the working tool in the contacting state.
Figure 4:
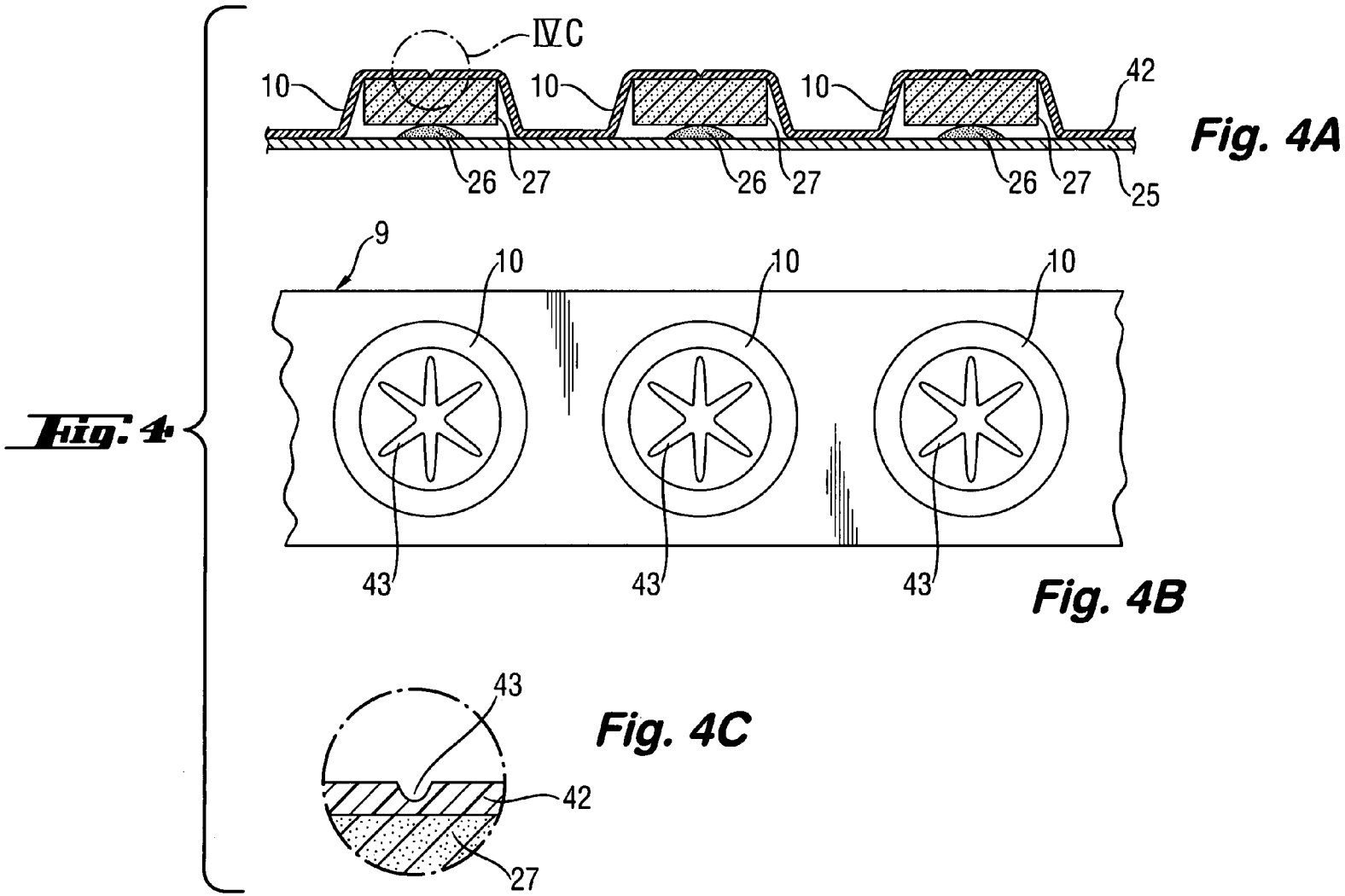
FIGS. 4A, B and C show a longitudinal section, a top view and an enlarged extract of a cartridge strip with blister cartridges for use in a working tool according to the invention.

FIG. 3 represents the setting tool according to FIGS. 1 and 2, in partial section and in the state in which it has been pressed with its tip or muzzle against an object 31.

As can be seen in FIG. 3, the setting tool comprises a muzzle—side adjusting member 32 that can be shifted relative to the housing body 1, which is displaceably mounted on a muzzle tube 33 in the direction of the central axis 4 of the setting tool. The muzzle tube 33 is screwed into the housing body 1 and receives the piston bar 34 of the piston 3. A compression spring 35 encompasses the muzzle tube 33 and lies between the front end of the housing body 1 and the face of the adjusting member 32 facing it. The adjusting member 32 is urged up to a stop (not shown) away from the device body 1 by virtue of the compression spring 35. A bar-shaped closure bar 28 is fixed to the adjusting member 23 and runs along the central axis 4 in the direction towards the device body 1. The closure bar 28 has a wedge 29 at its end facing towards the back of the device body 1. If the setting tool is not urged against the object 31 with its adjusting member 32, the compression spring 35 drives the adjusting member 32 forward such that the closure bar 28 cannot come to rest between the housing body 1 and the closure ring 8*a*. A reset spring (not shown) thus urges the closure ring 8*a* in FIG. 3 upwards and accordingly the impact plate 8 away from the recess 5. Now a blister cartridge 10 can be brought into the firing position. If the setting device, however, is pressed with its muzzle or with its adjusting member 23 against the object, then a fastening element 40 situated in the muzzle tube 33 can be driven into the object 31. The adjusting member 32 is displaced in the direction towards the housing body 1 and the compression spring 35 compressed. The closure bar 28 is moved into the housing body 1, whereby the forward wedge 29 has urged the closure ring 8*a* by the adjusting surface 30 down such that the packing sleeve 12 is moved over the impact plate 8 into the inside of the cylindrical recess 5. The packing sleeve 12 is now urged against the impact plate 8 by the compression spring 35 such that a certain initial pressure force is obtained for sealing the gap between the packing sleeve 12 and blister cartridge 9. If the trigger 39 is now operated, the cartridge 10, which is situated in the firing position is fired such that the packing sleeve 12 is initially urged in the direction of the impact plate 8 to create a better sealing action. This is done by the pressure action via the lower face 17 of the packing sleeve 12. The very high pressure forming in the cartridge chamber or in the firing chamber then drives the driver piston 3 via the communication chamber 7 to accelerate the driver piston 3 forward. Upon removal of the setting device from the object 31, the adjusting member 32 is again driven forward by the compression spring 35, whereby this movement can be taken advantage of by the compression spring 35 to then transport the blister cartridge belt 9 in the direction towards the muzzle of the setting tool to thus remove a spent blister cartridge 10 from the firing position and replace it with a fresh one. When this is done, the blister cartridge belt 9 is moved out of a magazine 41, in which it rolled up. This transport of the blister cartridge belt 9 can naturally occur only after the impact plate 8 has been moved a sufficient distance away from the cylindrical recess 5.

FIGS. 4A, 4B and 4C represent an enlargement of the structure of the blister cartridge belt 9. The blister cartridge belt 9 comprises an electrically conduction foil 25, which is an aluminum foil. Priming charges 26 are spaced thereon, wherein a propellant charge 27 is arranged on each of the priming charges 26. The respective group comprised of priming charge 26 and propellant charge 27 are covered by a plastic foil 42 to form a blister cartridge from each of these. Each of the blister cartridges 10 has a tear spot in the foil 42 in its raised zone; that is, a thinner wall thickness. It is identified with the reference 43. The tear spot faces the guide stud 15, when the blister cartridge 10 is in the firing position. After firing of the propellant charge 27, the blister cartridge 10 opens relatively quickly by virtue of the tear spot such that the pressure can build up with a high degree of efficiency.

Figure 5:
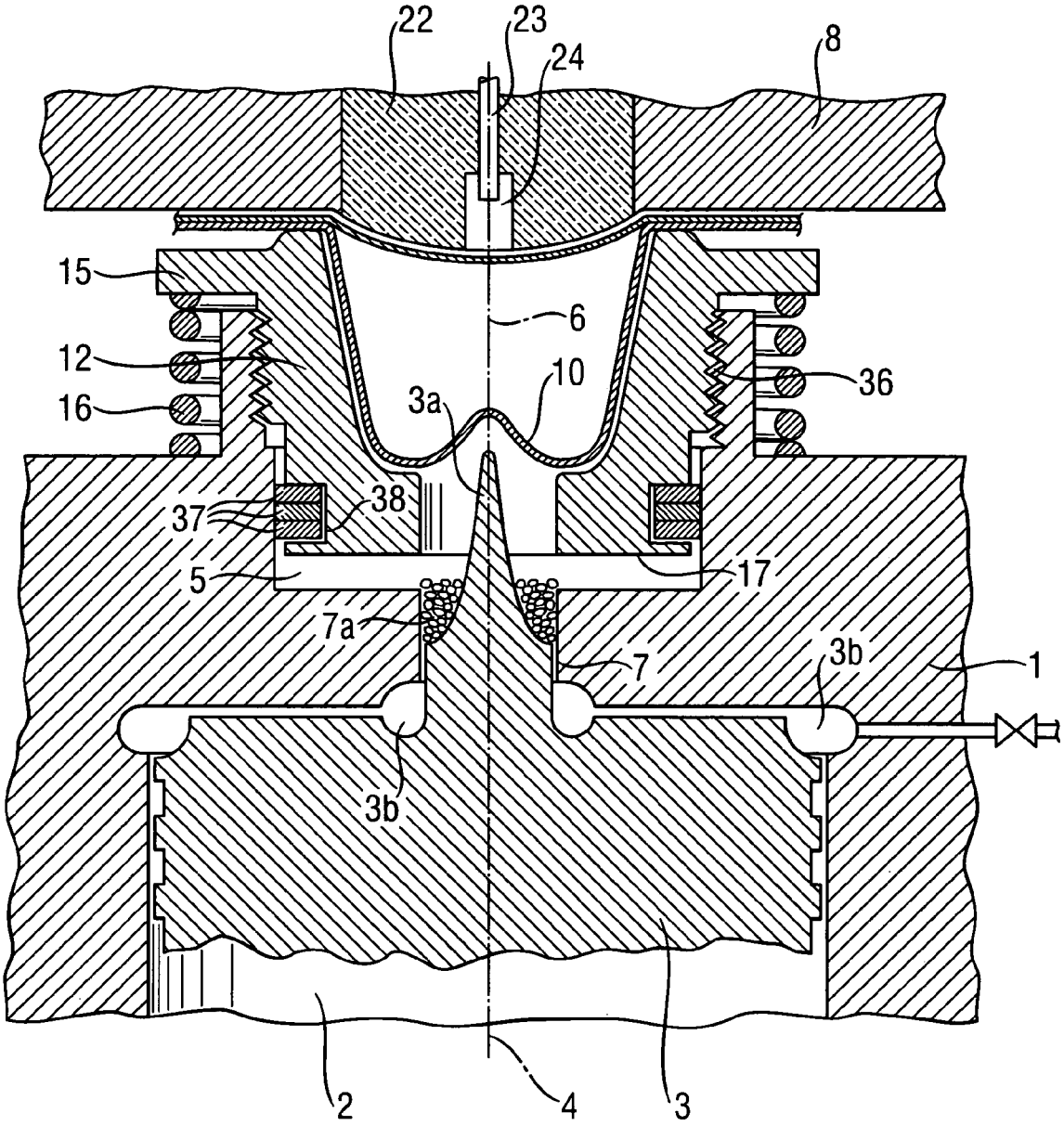
FIG. 5 shows an axial section through another working tool according to the invention.

A second exemplary embodiment of a working tool according to the invention is shown in FIG. 5. Parts identical to those of FIG. 1 are shown using the same references and are not described again. The difference is that in this case the cylindrical recess 5 is coaxial to the piston chamber 2. The central axis 4 is thus identical to the central axis 6. Again, the impact floor 8 can be moved away from the housing body 1 or towards the housing body 1, while the packing sleeve 1 is held elastically in the cylindrical recess 5. The compression spring 18 is used for this purpose and extends between the flange 15 and the housing body 1. The compression spring 18 attempts to urge the packing sleeve 12 away from the housing body 1. However such movement cannot happen, because the packing sleeve 12 is screwed into an inner threat on the peripheral wall of the cylindrical recess 5 using a peripheral external thread. This thread has the reference 36 and is configured as a so-called Schlotter-thread. It prevents the compression spring 16 from pushing out the packing sleeve 12 from the cylindrical recess 5, but at the same time makes it possible for the impact plate 8 to urge the packing sleeve 12 against the force of the compression spring 16 into the cylindrical recess 5. Accordingly, provision is made for a certain initial pressure force in the zone between the packing sleeve 12 and the impact floor 8. If the firing of the blister cartridge 10 occurs in the firing chamber, the high pressure pushes the packing sleeve 12 by its facial surface 17 in the direction of the impact plate 8 to provide a complete seal relative to the impact plate 8. This seal is then obtained in the zone of the Schlotter-thread 36. In addition, additional FEY rings 37 are present in the peripheral groove 38 of the packing sleeve 12 to provide a gap seal.

The blister cartridge 10 is opened by a pin 3*a* shortly after its firing, said pin can also be substituted by a blade after it has begun to expand. This pin or blade 3*a*, retracts from the trailing end of the driver piston 3 and protrude through the passage opening 7. The lack of seal of the needle in the direction of the driver piston 3 should be minimal. Therefore, the powder from the propellant charge seals the gap 7*a* for the needle 3*a* to the cartridge space. At the transition from the needle 3*a* to the driver piston 3 and at the external edge of the driver piston 3, helical chambers 3*b* are provided, which prevent any passage of powder grains and passage of gases.

Figure 6:
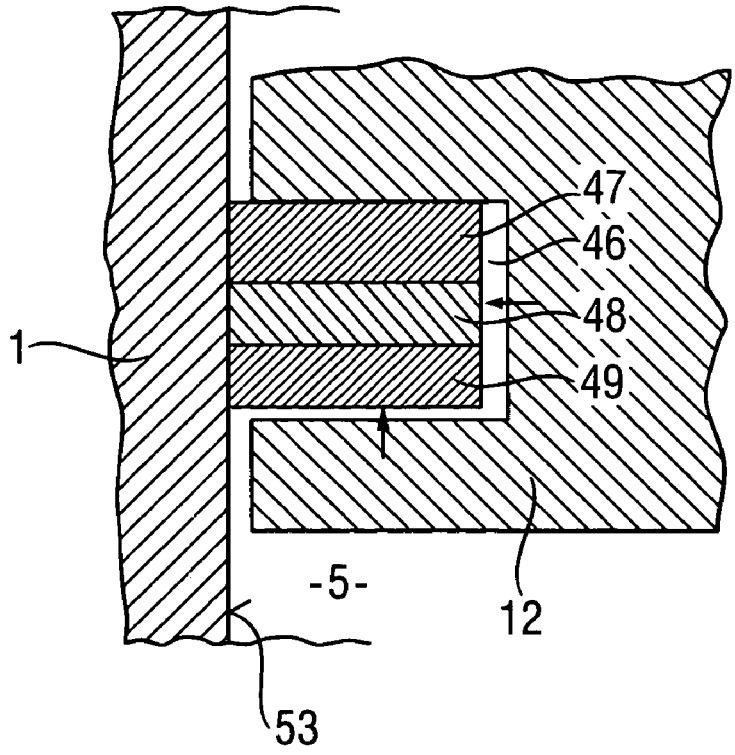
FIG. 6 shows a sealing assembly between the packing sleeve and the device body.

FIG. 6 shows the possibility of sealing a gap between the packing sleeve 12 and the inner wall of the cylindrical recess 5 by using at least three FEY rings 47, 48 and 49. The at least three FEY rings 47, 48 and 49 lie in an annular groove 46 on the outer peripheral wall of the packing sleeve 12. In the case of the at least three FEY rings 47, 48 and 49, these are slotted spring rings that are constructed similar to piston rings. In this case, there is the probability that all three slots or impact sites of the rings are over one another, practically so low, that it can be ignored. If a pressure builds up inside the combustion chamber or the cartridge chamber, it continues in the peripheral groove 46 and urges the FEY rings 47 to 49 on the one hand upwards in the direction towards the impact plate 8 and on the other hand radially downwards against the peripheral wall of the cylindrical recess 5 such that a very good gap seal is obtained. The respective pressure active assemblies are marked using the inscribed arrows.

Figure 7:
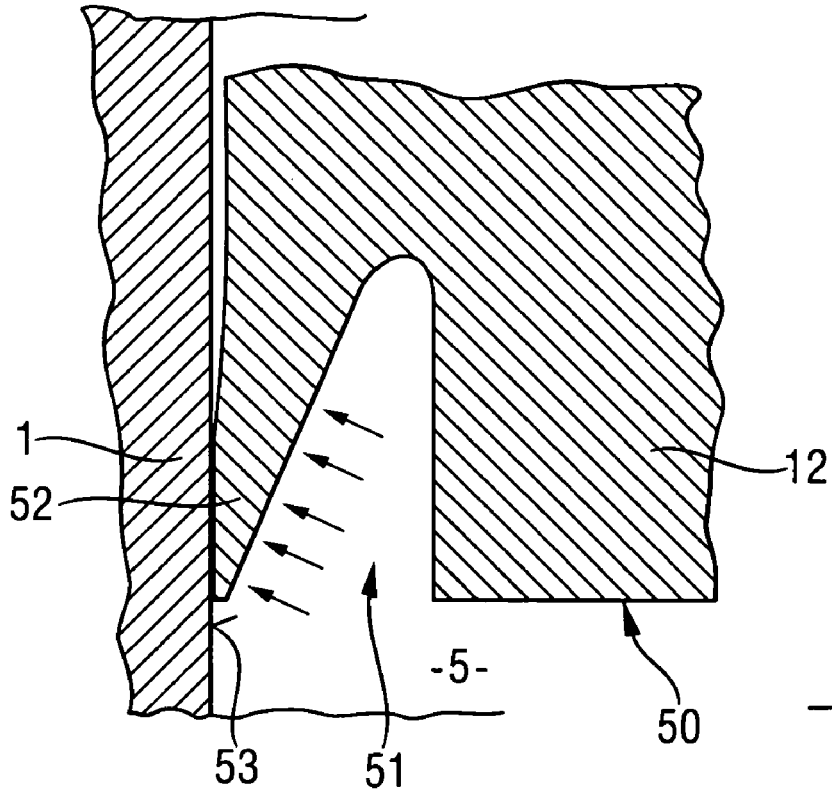
FIG. 7 shows a further sealing assembly for sealing a gap between the packing sleeve and the device body.

According to FIG. 7, a metal lip seal can also be provided between the packing sleeve 12 and the inner wall of the cylindrical recess 5. In this instance, the packing sleeve 12 has a peripheral recess 51 running in its facial surface 50 at its end facing away from the impact plate 8 for the formation of such a thin external wall section 52, such that it can be urged by the gas pressure against the inner wall 53 of the cylindrical recess 5.

Yet a further possibility for sealing the gap between the packing sleeve 12 and the inner wall of the cylindrical recess 5 is shown in FIGS. 8A, 8B. Here, hollow spaces 44 are provided in the peripheral wall of the cylindrical recess 5 and in the peripheral surface of the packing sleeve 12, wherein the thread insert 45 is installed in the hollow spaces 44. The hollow spaces 44 are configured spirally and receive the spirally configured thread insert 45. The relaxed state is shown in FIG. 8A, while the compressed state is shown in FIG. 8*b*. By virtue of the threaded insert 45, on the one hand a good gap seal is obtained, while on the other hand the threaded insert 45 acts as a very rigid reset spring. By means of the threaded insert 45, the packing sleeve 12 can be urged against the impact plate 8 with a pre-defined spring force, when the impact plate 8 is moved towards the device body 1 to obtain a very good initial seal in the zone between the packing sleeve 12 and the impact plate 8.

As already stated, a certain initial seal should be present even with low gas pressure and low contact pressure, upon firing a blister cartridge 10 present in the firing position. This is also advantageously obtained by deformation of the blister cartridge foil. This part of the contact pressure can thus be maintained low by minimizing the deformed foil surface. As a result, the deformation occurs with the smallest possible cut. The blister cartridge foil is not perforated by the very high closing forces at high gas pressure since the packing sleeve 12 runs up to a stop and the blade height is kept so low that the blade cannot penetrate the foil. The stop occurs on the foil in a flat zone. The tolerances can thus be more easily respected since only two small dimensions are involved. Also, the contact zone on the blister cartridge is large in comparison to the foil thickness. In this fashion, extrusion of the foil under high closing force is prevented.

A sufficiently large gap is provided on the side facing away from the seal for the action of the sealing zones in the vicinity of the blister cartridge foil to have effect such that any gases flowing out cannot generate any force for opening the packing sleeve 12. As a result, the packing sleeve is constantly urged by the combustion gases of the blister cartridge 10 in the direction of sealing.

Figure 9:
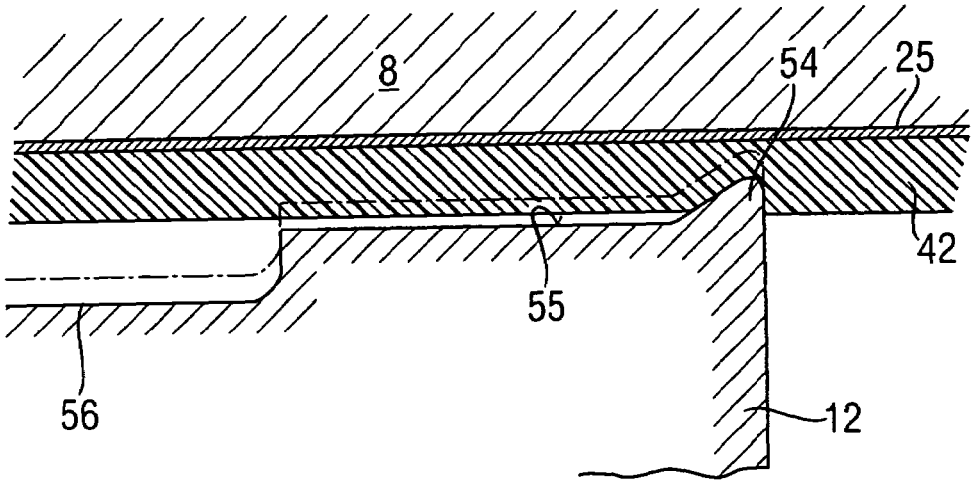
FIG. 9 shows the construction of the packing sleeve in its edge zone facing towards the impact plate.

FIG. 9 represents a possible embodiment of the face of the packing sleeve 8 facing the impact plate 8. This face of the packing sleeve 12 has a peripheral nub-like projection 54, which extends axially and, viewed radially, is arranged within. In the setting tool represented in FIG. 9, the high inside pressure builds up to the right. The nub-like projection 54 pushes into the blister cartridge foil 42 even at low gas pressure or low contact pressure and accordingly provides for an adequate initial pressure. Upon maximum pressure in the combustion chamber or in the cartridge space a further penetration of the projection 54 into the foil 42 occurs without severing it. The adjacent flat zone 55 of the packing sleeve 12 runs up on a stop against the foil 42. The broken line illustrates the packing sleeve 12 at maximum inside pressure. The face of the packing sleeve 12 is further retracted externally, especially in the zone 58. Should gases escape from the inner chamber, they can not longer generate force for opening the packing sleeve 12.

Figure 10:
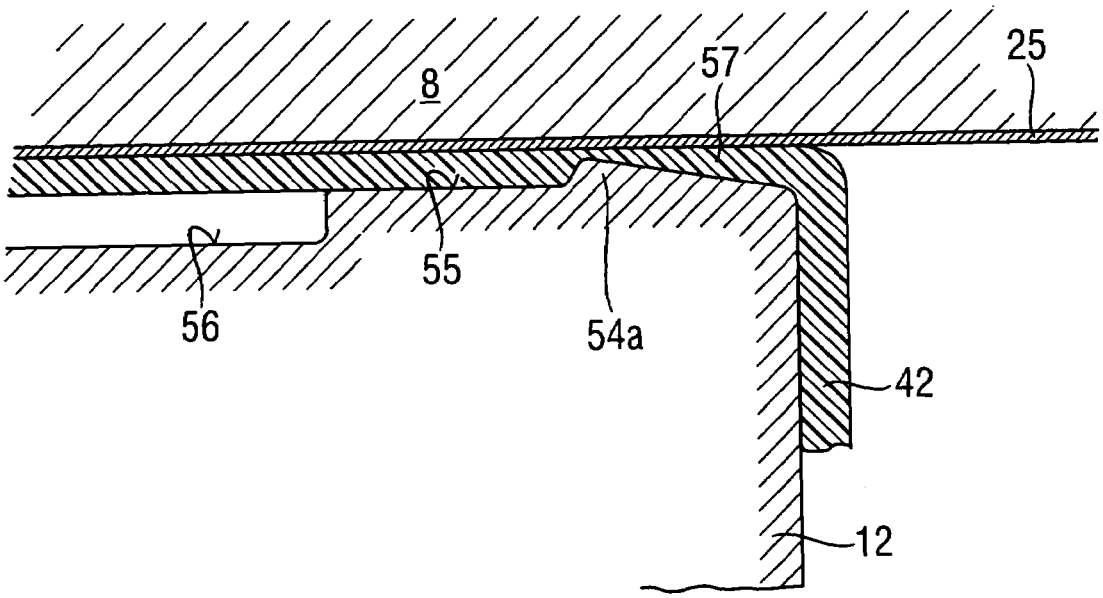
FIG. 10 shows a further packing sleeve in its edge zone facing towards the impact plate.

A further embodiment of the face of the packing sleeve facing the impact plate 8 is represented in FIG. 10. Again, the pressure side or the combustion space is to the right. Here, in contrast with the exemplary embodiment according to FIG. 9, the nub-like projection 54*a* is configured wedge-shaped so that it rises from the pressure space radially outwards in the direction of the impact plate 9. Accordingly, there results a radial wedge gap 57, which is filled by the foil 25, 42 and which provides a very good initial seal.

Figure 11:
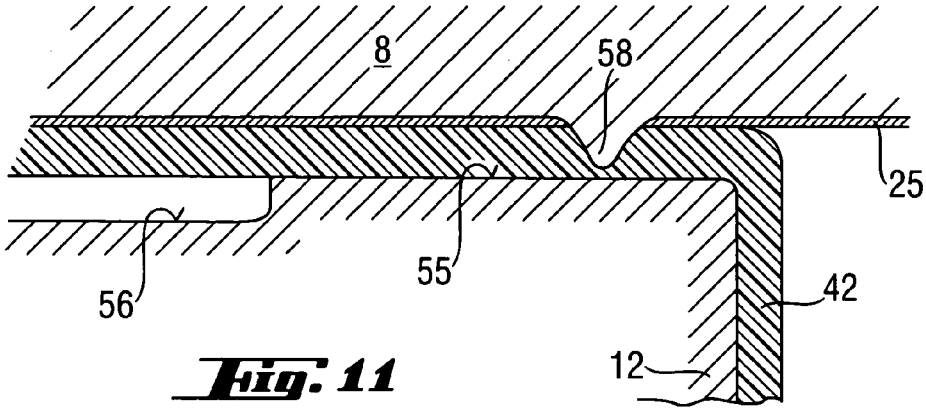
FIG. 11 shows a structuring of the impact plate in a zone situated opposite to the packing sleeve.
Figure 12:
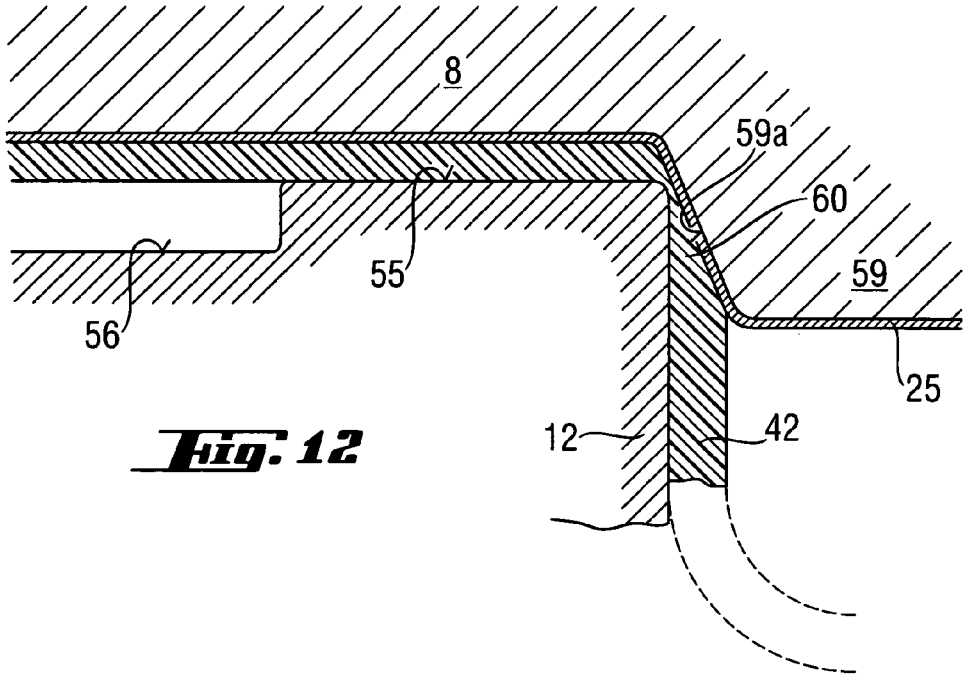
FIG. 12 shows a structuring of the impact plate in a zone situated opposite to the packing sleeve.

FIGS. 11 and 12 represent further exemplary embodiments of the initial seal, wherein corresponding structures are present in the impact plate 8. According to FIG. 11, the face 55 of the packing sleeve 12 facing the impact plate is parallel to the impact plate 8, wherein the otherwise even impact plate 8 opposing this face 55 has a peripheral, nub-like projection 58. If the packing sleeve 12 is urged against the impact plate 8, the projection 58 penetrates through the cover foil 25 or the aluminum foil on the one side and on the other side partially into the plastic foil 42 provides for a sufficient initial seal.

In the case of the exemplary embodiment according to FIG. 12, the face 55 of the packing sleeve facing towards the impact plate 8 is arranged parallel to the impact plate 8, while the otherwise even impact plate 8 has a truncated conical projection 59, which protrudes into the packing sleeve when it presses against the impact plate 8. The peripheral wall 59*a* of the truncated conical projection 59 runs diagonal to the cylinder axis 6 or diagonal to the inside wall of the cylindrical recess 5. In this manner, an axial wedge gap 60 is obtained between the inside wall of the cylindrical recess 5 and the diagonally running peripheral wall 59*a* of the projection 59, wherein the foils 25 and 42 are compressed resulting in a good initial seal.

Figure 13:
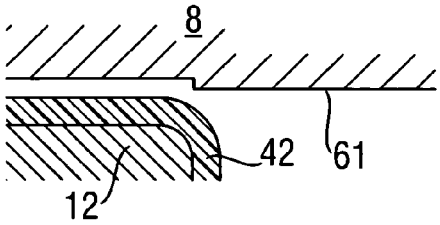
FIG. 13 shows another structuring of the impact plate.

FIG. 13 represents yet another embodiment of the impact plate 8 in the zone of the packing sleeve 12. In this instance, the impact plate 8 has a circular disk-like projection 61 opposite to the packing sleeve 12, whose peripheral edge lies opposite to the inner edge of the packing sleeve 12. If the packing sleeve 12 is urged against the impact plate 8, the edge of the circular disk-like projection 61 moves into the plastic foil 42 of the blister cartridge and thus effects an initial seal. The blister cartridge 12 and the impact plate 8 run up to a stop, whereby the height of the circular disk-like projection 61 is selected such that the plastic foil 42 is not severed. With reference to the impact plate 8, the circular disk-like projection 61 has a height that can be 0.1 to 0.2 mm. In this case, the edge of the circular disk-like projection 61 need not necessarily be flush with the inner wall of the packing sleeve 12 but can also be radially offset relative to same.

Figure 14:
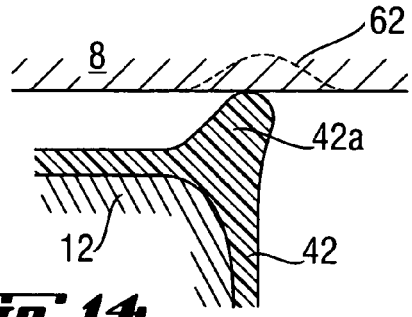
FIG. 14 shows a particular embodiment of the plastic foil of a blister cartridge.

FIG. 14 represents a particular embodiment of the plastic foil of a blister cartridge on the side of the plastic foil facing towards the impact plate 8. The impact plate 8 is configured completely flat, while the plastic foil 42 of the blister cartridge has a nub facing in the direction towards the impact plate 8 and diagonal to the center of the packing sleeve 12, said nub lying above the inner peripheral edge of the blister cartridge 12. If the blister cartridge 12 is moved against the impact plate 8, the nub, which is identified with reference 42*a*, is urged in the direction towards the center of the packing sleeve, such that the material of the nub 42*a* can be pressed into the resulting gap between the impact plate 8 and the packing sleeve 12, when an overpressure is produced on the inside of the packing sleeve 12. In the embodiment represented in FIG. 14, the impact plate can also have a peripheral or annular recess 62 that lies opposite to the nub 42*a* and into which the nub can engage when the impact plate 8 and the packing sleeve 12 are moved towards each other. As a result, a very good initial seal is obtained.

What is claimed is:

1. A combusting-operated working tool for driving in fastening elements, comprising:

a housing body (1)having a cylindrical recess (5) and a piston chamber (2) for receiving a piston (3) and communicating with the cylindrical recess (5);

an impact plate (8) located opposite the cylindrical recess (5) at a distance therefrom and displaceable toward and away from the housing body (1);

a packing sleeve (12) for receiving a tool-operating cartridge (10) and displaceably arranged in the cylindrical recess (5) and projecting therefrom; and spring means for biasing the packing sleeve (12) against the impact plate (8).

2. The working tool of claim 1, wherein central axes (4, 6) of the piston chamber (2) and the cylindrical recess (5) extend at an angle to each other.

3. The working tool of claim 2, wherein the angle is 90°.

4. The working tool of claim 1, wherein the central axes (4, 6) of the piston chamber (2) and the cylindrical recess (5) extend coaxially to each other.

5. The working tool of claim 1, wherein the packing sleeve (12) has an adjustment surface (17) by which the packing sleeve (12) can be urged against the impact plate (8) by gas pressure that builds up after firing of the cartridge (10) and forms the biasing means.

6. The working tool of claim 5, wherein the adjustment surface forms a lower face (17) of the packing sleeve (12) spaced from a bottom of the cylindrical recess.

7. A working tool of claim 1, further comprising a plurality of seals (18, 37, 45, 47–49, 52) provided along a circumference of the packing sleeve (12).

8. A working tool of claim 1, wherein the packing sleeve (12) is provided in an end surface (50) thereof remote from the impact plate (8) with a circumferential recess (51) for forming a thin outer wall section (52) a thickness of which is so selected that the wall section (52) is urged against an inner wall (53) of the cylindrical recess (5) upon gas pressure being applied thereto.

9. The working tool of claim 1, wherein the packing sleeve (12) is screwed into the cylindrical recess (5) by a Schlotter-thread (36).

10. The working tool of claim 1, wherein the packing sleeve (12) is screwed into the cylindrical recess (5) by a threaded insert (45).

11. The working tool of claim 1, wherein the packing sleeve (12) has an outer peripheral flange (15), and wherein the spring means comprises a compression spring (16) arranged between the packing sleeve (12) and the housing body (1).

12. The working tool of claim 1, wherein the impact plate (8) is a solid, closed ring (8*a*), and wherein a central axis (6) of the cylindrical recess (5) lies in an annular plane of the closed ring (8*a*).

13. The working tool of claim 1, having an adjusting member (32) on a muzzle—side that can be displaced relative to the housing body (1) for regulating a displacement mechanism (25, 29) for the impact plate (8), wherein the displacement mechanism (25, 29) moves the impact plate (8) toward the housing body (1) when the adjusting member (32) is displaced toward the housing body (1), and the impact plate (8) moves away from the housing body (1) when the adjusting member (32) again moves away from the housing body (1).

14. The working tool of claim 13 having a bar (28) for locking the impact plate (8) when the impact plate (8) is displaced toward the housing body (1).

15. The working tool of claim 14, wherein the locking bar (28) is part of the displacement mechanism (25, 29).

16. The working tool of claim 13, wherein the cartridges (1) is transported into a zone between the packing sleeve (12) and the impact plate (8) upon displacement of the adjustment member (32).

17. The working tool of claim 1, wherein the cartridges are blister cartridges (10) connected with each other to form a belt (9).

18. The working tool of claim 17, wherein the blister cartridges (10) project only over one side of the belt (9), and wherein a flat, back part of the belt rests on the impact plate (8).

19. The working tool of claim 1, wherein the packing sleeve (12), has a face (55) facing toward the impact plate (8) and having a peripheral, nub-like projection (54, 54*a*) extending axially.

20. The working tool of claim 19, wherein the face (55) lies parallel to the impact plate (8), and a peripherally running nub-like projection (58) is arranged opposite the face (55).

21. The working tool of claim 19, wherein the face (55) lies parallel to the impact plate (8), and wherein a truncated conical projection (59) protrudes into the packing sleeve (12) when the packing sleeve (12) presses against the impact plate (8).

22. The working tool of claim 19, wherein the face (55) lies parallel to the impact plate (8) and wherein the impact plate (8) has a circular disk-like projection (61) having a peripheral edge thereof lying opposite to an inner edge of the packing sleeve (12).

* * * * *